United States Patent [19]

Huang

[11] Patent Number: 4,671,383

[45] Date of Patent: Jun. 9, 1987

[54] LADDER LEVELLER

[76] Inventor: Yeong-Maw Huang, P.O. Box 68-941, Taipei, Taiwan

[21] Appl. No.: 877,200

[22] Filed: Jun. 23, 1986

[51] Int. Cl.[4] ..... E06C 7/44

[52] U.S. Cl. ..... 182/204; 182/111

[58] Field of Search ..... 182/200, 201, 204, 202, 182/108, 107, 111; 248/188.1, 188.6

[56] References Cited

U.S. PATENT DOCUMENTS

| | | | |
|---|---|---|---|
| 2,481,581 | 9/1949 | Ehnhuus | 182/201 |
| 2,608,336 | 8/1952 | Dole | 182/201 |
| 2,830,852 | 4/1958 | Fritz | 182/204 |
| 3,908,796 | 9/1975 | Hurwitz | 182/201 |
| 3,937,298 | 2/1976 | Hurwitz | 182/204 |
| 4,095,671 | 6/1978 | Forristall | 182/202 |
| 4,143,742 | 3/1979 | Fernandez | 182/201 |

*Primary Examiner*—Reinaldo P. Machado

[57] ABSTRACT

A ladder leveller includes an adjustable base having two adaptors suitable for receiving the ladder feet and a pair of telescopic legs respectively fixed under the two adaptors, wherein both the telescopic legs can be optionally adjusted their heights to allow the base and the ladder feet riding on the base horizontally standing on a rugged floor surface in a stable way.

4 Claims, 8 Drawing Figures

LADDER LEVELLER

BACKGROUND OF THE INVENTION

Conventional ladder having a pair of equal-length legs can stably stand on a flat floor, which however may be unstable to stand on a rugged surface, to even cause an accident due to collapse or slippery of the ladder.

The ladder feet may be coated or packed with a rubber cushion to prevent slippery. However, it still can not be used on a rugged surface. If setting up such a ladder inclinedly to support on a vertical wall, the rubber cushion on each foot may only tangentially touch the floor surface, without fully scratching it, to thereby possibly cause a slippery accident.

The present inventor has found the defects of a conventional ladder and invented the present ladder leveller.

SUMMARY OF THE INVENTION

The object of the present invention is to provide a ladder leveller including an adjustable base and a pair of telescopic legs respectively fixed under the base in which either of the two telescopic legs can be optionally extended or retracted to keep the base and the ladder feet riding thereon being horizontally standing on a rugged floor.

DETAILED DESCRIPTION

Figure 1:
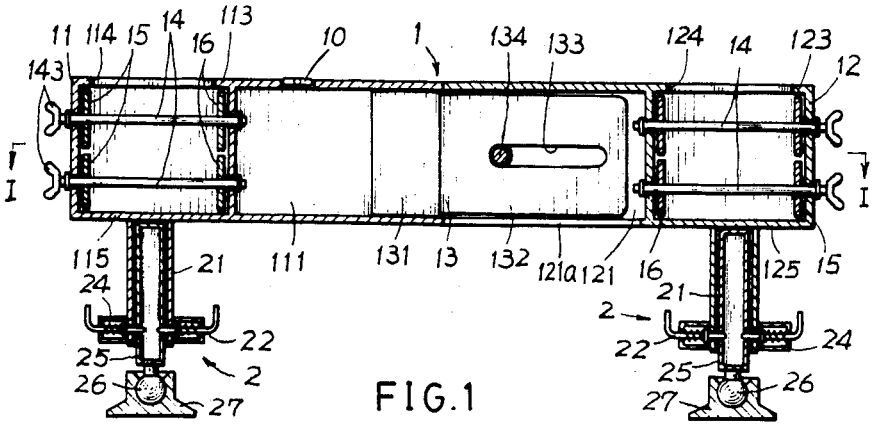
FIG. 1 is a sectional drawing of an elevation of the present invention.
Figure 2:
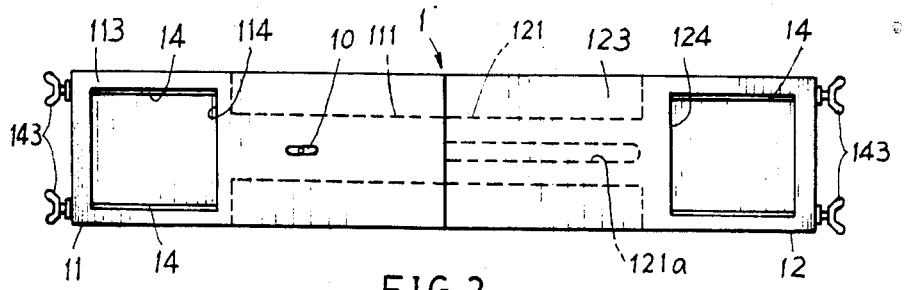
FIG. 2 is a top view of FIG. 1 in accordance with the present invention.
Figure 3:
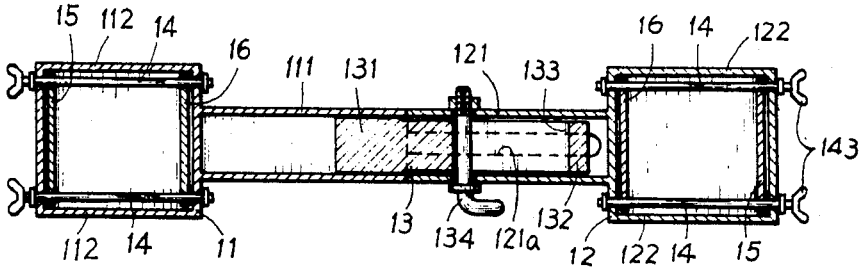
FIG. 3 is a sectional drawing as viewed from II direction of FIG. 1.
Figure 4:
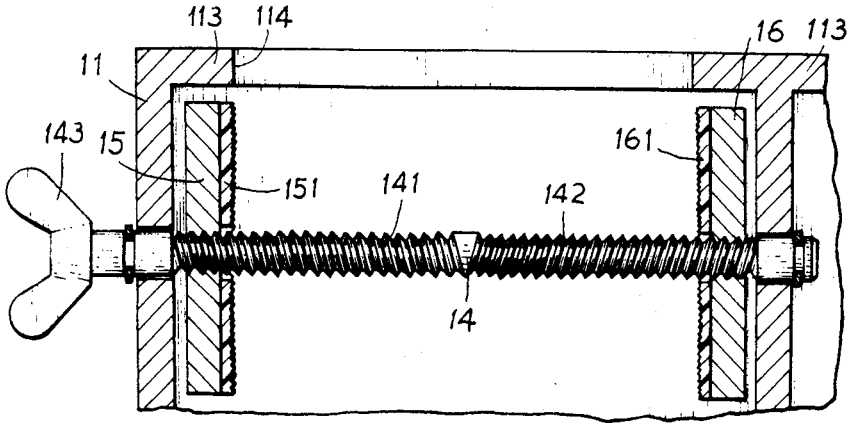
FIG. 4 is an illustration showing the adjustable clamping panels in accordance with the present invention.

As shown in the figures, the present invention comprises an adjustable base 1 and a pair of telescopic legs 2 fixed under the base 1.

The adjustable base 1 includes: a first adaptor 11 having a right-arm portion 111 transversely extending rightward from the adaptor 11 and a telescopic leg 2 fixed under the adaptor 11, a coupling tenon 13, and a second adaptor 12 having a left-arm portion 121 transversely extending leftward from the adaptor 12 adapted for the coupling by the tenon 13 and a telescopic leg 2 fixed under the adaptor 12.

The first adaptor 11 includes a parallelepiped portion 112 having a socket 114 formed on the top portion 113 of the adaptor 11, at least a pair of adjusting screws 14 each formed with a leftward thread 141 and a rightward thread 142 centrally divided from each screw 14 and a handle 143 protruding outside the parallelepiped portion 112 and each transversely formed across the parallelepiped portion 112, at least a pair of clamping panels 15, 16 of which the left clamping panel 15 adhered with an anti-slipping pad 151 thereon is adjustably driven by the leftward thread 141 and the right clamping panel 16 adhered with an anti-slipping pad 161 thereon is adjustably driven by the rightward thread 142, adapted for adjustably clamping a ladder foot inserted into the socket 114, and a bottom portion 115 formed under the parallelepiped portion 112 for fixing the telescopic leg 2 thereunder.

The coupling tenon 13 includes a plugging portion 131 fixed into the right-arm portion 111, an extending portion 132 extending rightward from the plugging portion 131, a slit 133 transversely formed on the extending portion 132 and a locking screw 134 passing through the slit 133 and adjustably fixing the left-arm portion 121 movably jacketing on the extending portion 132. The left-arm portion 12 is formed with an open slit **121*a* on the bottom of left-arm portion 121 for easier fastening operation by the locking screw 134**.

The second adaptor 12 includes a parallelepiped portion 122 having a socket 124 formed on the top portion 123 of the adaptor 12, at least a pair of adjusting screws 14 transversely foremd across the parallelepiped portion 122, at least a pair of clamping panels 15, 16 driven by the pair of the adjusting screws 14, adapted for adjustably clamping the other ladder foot inserted into the socket 124, and a bottom portion 125 formed under the parallelepiped portion 122 for fixing the other telescopic leg 2 thereunder. A bubble level 10 is fixed on the top portion 113 or 123 for checking the horizon of the base 1. Each telescopic leg 2 as shown in FIG. 5 includes a sleeve portion 21 fixed under either adaptor 11 or 12, an inner cylinder 25 movably jacketed in the sleeve portion 21 and longitudinally formed with two rows of plural holes 251 disposed on both sides of the cylinder 25, a pair of positioning latches 22 respectively disposed on both sides of the sleeve portion 21 each resiliently poking through a latch hole 211 formed on the sleeve portion 21 and any hole 251 of the cylinder 25 to fix the cylinder 25 with the sleeve portion 21, a ball 26 fixed under the cylinder 25 and a cushion 27 universally coupled with the ball 26.

The positioning latch 22 is formed with a tapered tip 221 poking through holes 211, 251, a shank portion 222 jacketed with a spring 23 held in a casing 24, a handle portion 223 for operating the latch and a limiting disk 224 retained by the spring 23 to normally poke the latch inwards towards the cylinder 25.

The cushion 27 is formed with a spherical socket 271 adapted for universally receiving a ball 26, and formed with an anti-slipping bottom surface 272 under the cushion 27.

Figure 5:
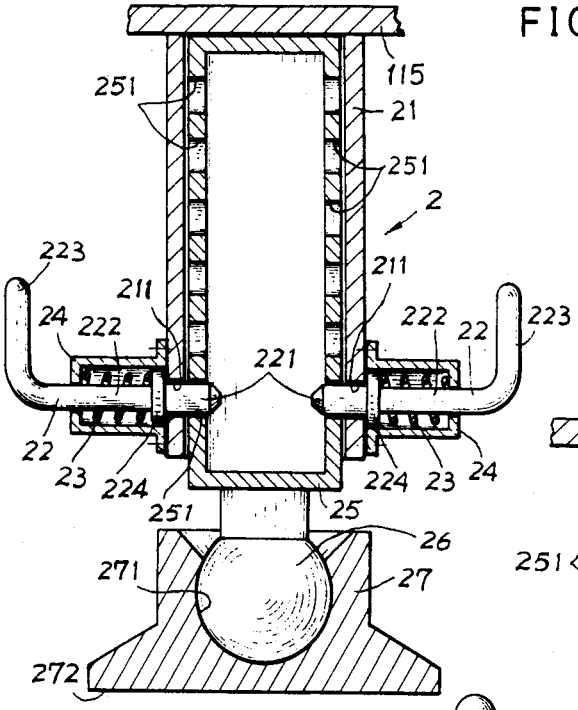
FIG. 5 is a sectional drawing of the telescopic leg of the present invention.
Figure 6:
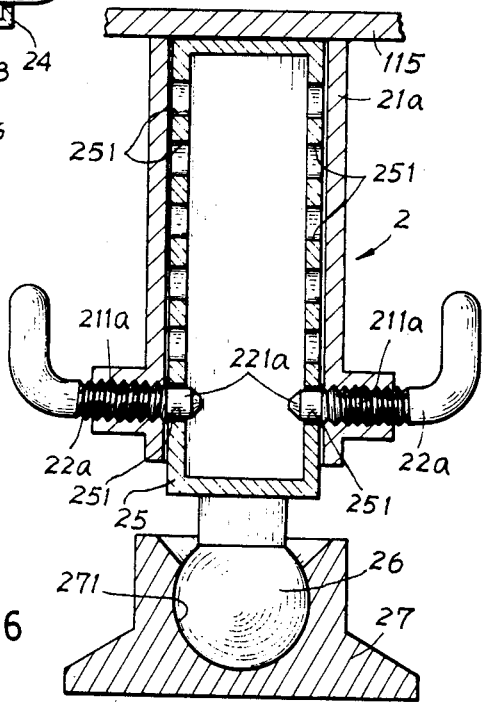
FIG. 6 shows another preferred embodiment of the telescopic leg of the present invention.

Another preferred embodiment of the telescopic leg 2 of the present invention is shown in FIG. 6, which is similar to the leg as shown in FIG. 5 and further includes a pair of positioning latches **22*a* each formed with a male-threaded portion to engage with a female-threaded hole 211*a* formed on either side of the sleeve portion 21*a* and a tip 221*a* to poke inwards toward the cylinder 25**.

Figure 7:
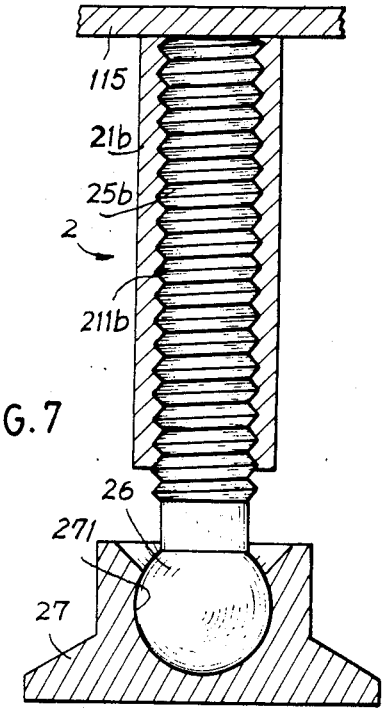
FIG. 7 shows still another preferred embodiment of the leg of the present invention.

Still another preferred embodiment of the leg 2 of the present invention is shown in FIG. 7, which includes a sleeve portion **21*b* fixed under either adaptor 11 or 12 having formed with a female-threaded hole 211*b*, and a male-threaded bolt 25*b* engaged with the female-threaded hole 211*b* having a cushion 27** universally mounted thereunder.

By operating the positioning latches of FIGS. 5, 6 and by rotating the bolt 25*b*, the height of each leg 2 can be adjusted to level the base 1.

Figure 8:
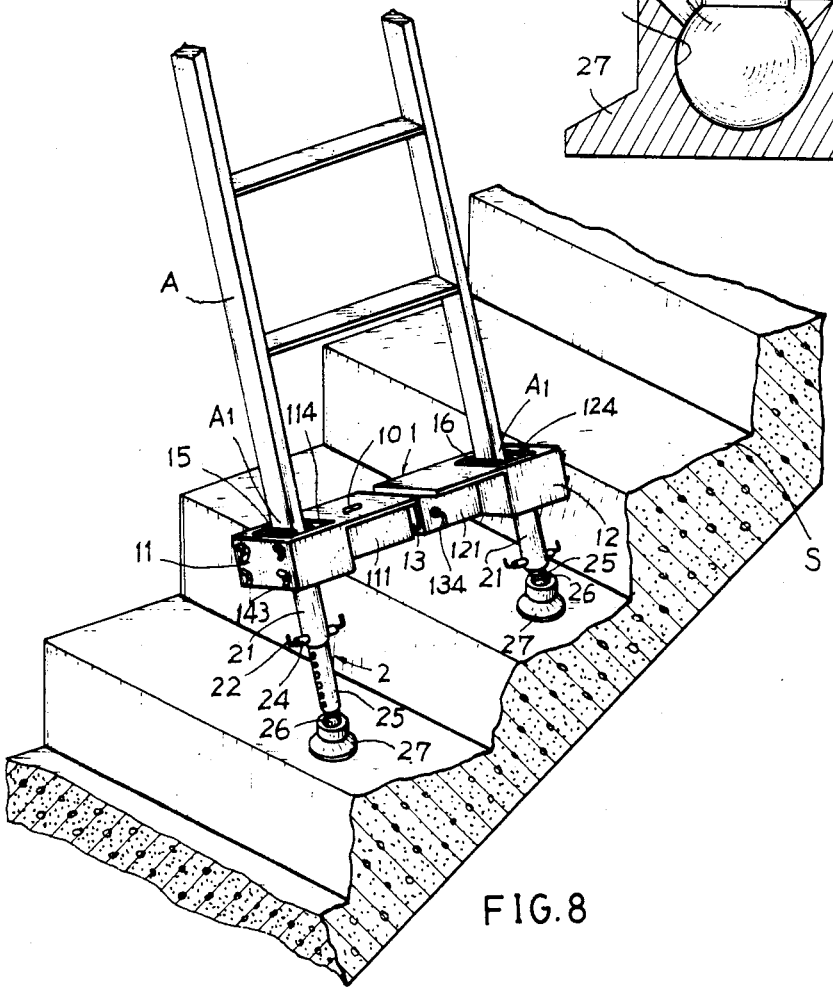
FIG. 8 is an illustration showing the application of the present invention.

When using the present invention as shown in FIG. 8, the feet A1 of a ladder A are inserted into the sockets 114, 124 of the two adaptors 11, 12 and the screws 14 are operated to drive the panels 15, 16 to firmly clamp the ladder feet A1, and the telescopic legs 2 are adjusted to allow the base 1 and the ladder feet A1 horizontally standing on the different-height steps of a stairway S. The ladder A with the base 1 will then be inclinedly supported on a vertical wall by the universal rotation of the two balls 26 in the two cushions 27.

Accordingly, this invention has the following advantages, compared with a conventional ladder:

1. The ladder can stably stand on a rugged surface by adjusting the two telescopic legs 2 to level the base 1.

2. The leg 2 and base 1 may be universally rotated to stably lay on a vertical wall with fully scratching of the floor (touching) surface by the anti-slipping cushions 27.

The right-arm portion 111 of first adaptor 11 can be directly linked with the left-arm portion 121 of second adaptor 12 to eliminate the tenon 13 so as to save the production cost of this invention to form a base 1 with fixed width, which is also fallen into the scope of this invention.

I claim:

1. A ladder leveller comprising:

an adjustable base having a first adaptor formed with a socket on its top portion, a right-arm portion transversely extending rightward from said first adaptor, and a second adaptor formed with a socket thereon, a left-arm portion transversely extending leftward from said second adaptor to be adjustably coupled by a coupling tenon inserted in said right-arm portion of said first adaptor, both sockets adapted for receiving the ladder feet; and a pair of telescopic legs each fixed under the bottom of any one said adaptor;

each said telescopic leg including: a sleeve portion fixed under the bottom of any said adaptor, an inner cylinder movably jacketed in said sleeve portion having two rows of plural holes each row of holes longitudinally formed on either of the two sides of said cylinder, a pair of positioning latches each poking through a latch hole formed on said sleeve portion and through said hole on said cylinder for fixing said cylinder with said sleeve portion, a ball formed under said cylinder and a cushion having anti-slipping bottom surface for scratching the floor surface and a spherical socket for universal coupling of said ball of said cylinder.

2. A ladder leveller according to claim 1, wherein any one said adaptor includes a parallelepiped portion having a socket formed thereon, at least a pair of adjusting screws transversely formed across said parallelepiped portion, and at least a pair of clamping panels each driven by the two adjusting screws, adapted for adjustably clamping the ladder foot as inserted into said sockets, each said adjusting screw formed with a leftward thread movably engaged with a clamping panel and a rightward thread movably engaged with a right clamping panel opposite to said left panel, whereby upon the driving of said screws, said panels will clamp the ladder foot therebetween.

3. A ladder leveller according to claim 1, wherein said positioning latch is tensioned by a spring held in a casing formed on one side of said sleeve portion to resiliently poke a latch tip through a latch hole of said sleeve portion and a hole of said inner cylinder for fixing the sleeve portion with the cylinder.

4. A ladder leveller according to claim 1, wherein said positioning latch is formed with a male-threaded portion to engage with a female-threaded hole formed on said sleeve portion.

* * * * *